US006415440B1

(12) United States Patent
Stinton

(10) Patent No.: US 6,415,440 B1
(45) Date of Patent: Jul. 9, 2002

(54) DIVER'S SUIT WITH DIAGONAL TORSO ZIPPER THAT PARTIALLY ENCIRCLES THE WAIST

(75) Inventor: Robert T. Stinton, Lakeside, CA (US)

(73) Assignee: Diving Unlimited International, Inc., San Diego, CA (US)

( * ) Notice: Subject to any disclaimer, the term of this patent is extended or adjusted under 35 U.S.C. 154(b) by 0 days.

(21) Appl. No.: 10/032,050

(22) Filed: Dec. 20, 2001

(51) Int. Cl.[7] ..... B63C 11/04
(52) U.S. Cl. ..... 2/2.17
(58) Field of Search ..... 2/2.17, 69, 87, 2/270, 275, 71, 79, 227, 114, 82, 83, 93, 456–458, 2.11, 2.14–2.16, 60, 69.5, 901

(56) References Cited

U.S. PATENT DOCUMENTS 3,493,972 A * 2/1970 Oldham ..... 2/2.17
3,643,264 A * 2/1972 Rector ..... 2/2.17
4,464,795 A 8/1984 Long et al.
4,862,517 A * 9/1989 Meistrell ..... 2/2.17
5,191,658 A * 3/1993 Meistrell ..... 2/2.17
5,806,090 A 9/1998 Johnson
6,219,841 B1 * 4/2001 Anderson ..... 2/2.17

* cited by examiner

*Primary Examiner*—Gloria M. Hale
*Assistant Examiner*—Tejash Patel
(74) *Attorney, Agent, or Firm*—Michael H. Jester

(57) ABSTRACT

A diving suit has a suit body made of a waterproof material. The suit body has an upper torso portion configured for enclosing an upper torso of a diver. The upper torso portion includes a pair of sleeves for enclosing the diver's arms and an opening for the diver's neck. The suit body has a trousers portion for enclosing the diver's legs. The upper torso portion further has an opening sealed by a zipper. An upper segment of the opening extends diagonally across a front panel of the upper torso portion from one shoulder area of the upper torso portion. A lower segment of the opening partially encircles a waist area of the upper torso portion. This increases the effective length of the opening and makes it easier for the diver to put on and take off the diving suit.

20 Claims, 4 Drawing Sheets

DIVER'S SUIT WITH DIAGONAL TORSO ZIPPER THAT PARTIALLY ENCIRCLES THE WAIST

FIELD OF THE INVENTION

The present invention relates to underwater diving equipment, and more particularly, to garments worn by professional and sports divers for warmth and protection during scuba diving.

BACKGROUND OF THE INVENTION

Underwater diving suits are cumbersome to put on (don) and take off (doff) because they must fit snugly over the diver's body. People have widely varying heights and weights. While wet suits are made of fabric reinforced neoprene which is relatively stretchable, dry suits are typically sewn from a relatively non-stretchable tri-laminate material consisting of Nylon woven fabric sandwiching a synthetic rubber layer. Dry suits are usually a one-piece design because it is not practical to put on and reliably joint and seal separate trouser and torso portions. They typically include a diagonal opening which spans the front of the torso and is opened and closed by a heavy waterproof zipper. Dry suits have a neck seal which must be pulled up over the head and forced down over the head. Where the dry diver's suit has integral gloves, the neck seal must be pulled over the head before the diver's arms are extended into the sleeves and gloves.

Various diving suits have been developed to overcome the aforementioned problems. U.S. Pat. No. 4,464,795 of Richard W. Long and Robert T. Stinton discloses a widely commercialized design in which the torso portion of the suit is longer than the diver's torso height. A diagonal zippered opening in the front of the torso extends from the left shoulder to the right hip to provide a large opening for ingress and egress of the diver's legs and arms. After the diver has donned the suit, the zipper is closed and the extended torso portion is rolled over to adjust to the height of the diver. Either a crotch strap or suspenders are used to secure the suit in this shortened configuration.

U.S. Pat. No. 5,806,090 of Johnson discloses a one-piece diving suit with a stretchable waist band connected to the upper and lower torso portions which allows the upper portion to move relative to the lower portion while the diver is entering the suit. Once again the suit uses a zippered opening which extends diagonally across the front of the torso.

In another prior art diving suit a zippered opening extends diagonally across the front of the upper torso portion of the suit. To allow longitudinal expansion required for easy diver access and slipping the neck seal over the diver's head, a second zippered opening is used in a rear panel of the suit. This allows the diver to pull the neck of the suit over his or her head. The zippers in the forward and rearward sides of the upper torso portion are then closed after the suit is fully on the body of the diver. The rearward zipper is difficult for the diver wearing the suit to close, and generally must be zipped shut by a buddy.

It would be desirable to enlarge the zippered opening in a diver's suit to allow easier ingress and egress. However, it is highly undesirable for the diagonal opening in diving suits of this type to extend below the waist. This is because the heavy zipper is very uncomfortable to the diver when the diver sits or bends over. Also, waterproof zippers can be damaged from kinking due to excessive bending under such circumstances.

SUMMARY OF THE INVENTION

It is therefore the primary object of the present invention to provide a one-piece diver's suit that is easier to don and doff In accordance with the present invention, a diving suit has a suit body made of a waterproof material. The suit body has an upper torso portion configured for enclosing an upper torso of a diver. The upper torso portion includes a pair of sleeves for enclosing the diver's arms and an opening for the diver's neck. The suit body has a trousers portion for enclosing the diver's legs. The upper torso portion further has an opening sealed by a zipper. An upper segment of the opening extends diagonally across a front panel of the upper torso portion from one shoulder area of the upper torso portion. A lower segment of the opening partially encircles a waist area of the upper torso portion. This increases the effective length of the opening and makes it easier for the diver to put on and take off the diving suit.

DESCRIPTION OF THE PREFERRED EMBODIMENT

Figure 1:
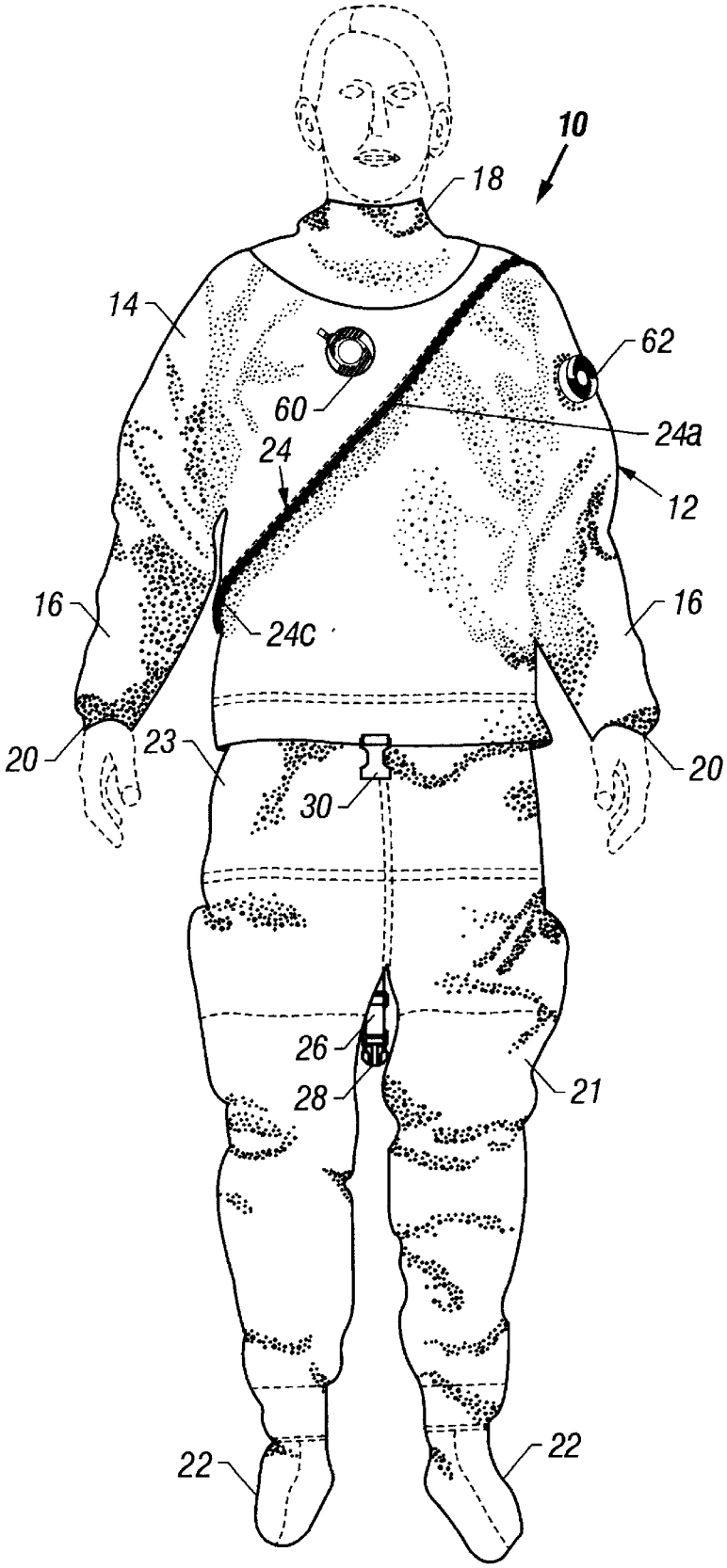
FIG. 1 is a front elevation view of a preferred embodiment of a diving suit in accordance with the present invention.
Figure 2:
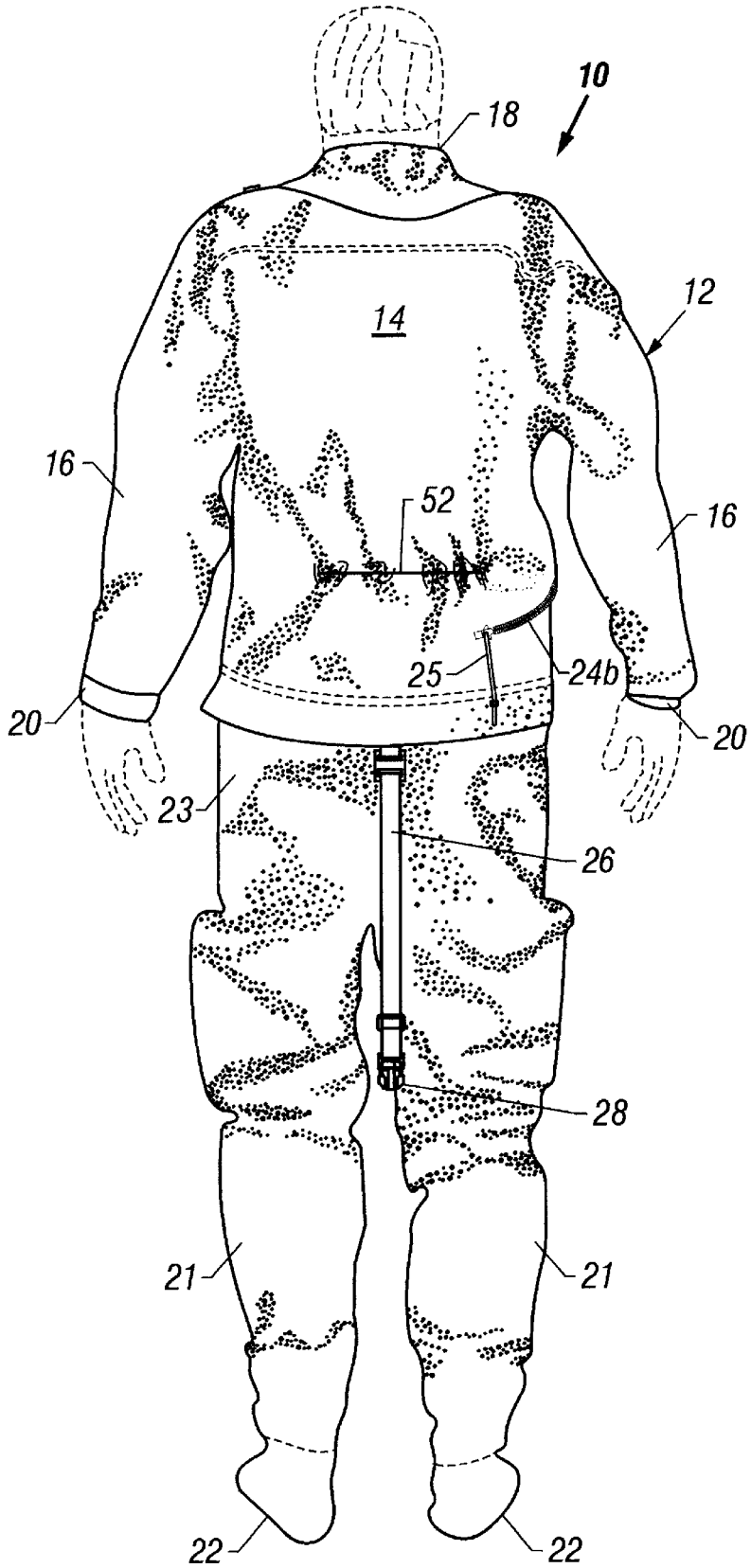
FIG. 2 is a rear elevation view of the diving suit of FIG. 1.

Referring to FIGS. 1 and 2 a diving suit 10 has a suit body 12 made of a suitable waterproof material. The suit body 12 has an upper torso portion 14 configured for enclosing an upper torso of a diver. The upper torso portion 14 includes a pair of sleeves 16 for enclosing the diver's arms and an opening for the diver's neck defined by a neck seal 18. The suit body 12 further includes a pair of wrist seals 20 each surrounding a corresponding sleeve end. The suit body 12 has a lower trousers portion 21 for enclosing the diver's legs. Boots 22 are connected to the ends of each leg of the trousers portion 21. The suit body 12 further includes an extended torso portion 23 connecting the upper torso portion 14 and the trousers portion 21.

The upper torso portion 14 of the suit body 12 has an opening 24 sealed by a conventional waterproof zipper. An upper segment 24*a* of the opening extends diagonally across a front panel of the upper torso portion 14 from the left shoulder area of the upper torso portion 14 to a point near the right hip area. Preferably the upper end of the upper segment 24*a* of the zippered opening extends over the top of the left shoulder. A lower segment 24*b* of the opening partially encircles a waist area of the upper torso portion 14. The lower segment 24*b* (FIG. 2) of the zippered opening extends to a medial area of back panel of the upper torso portion 14 of the suit body 12. This increases the effective length of the opening and makes it easier for the diver to put on and take off the diving suit. The lower segment 24*b* of the zippered opening extends generally transverse to a longitudinal axis of the suit body 12. A curved segment 24*c* of the opening 24 connects the straight diagonal segment 24*a* with the waist encircling segment 24*b*. The waist area of the upper torso portion 14 of the suit body 12 is that part which generally overlies the area between the diver's hips and ribs. The zippered opening 24 does not cross the diver's waist so that the waterproof zipper is not kinked when the diver bends over or sits. The terminal portion of the upper segment 24*a* wraps partially around and over the left shoulder of the diver.

The suit body 12 could be made of fabric backed neoprene foam material that is cut into sections and glued and stitched together to form a wet suit. However, more preferably, the suit body is made of a tri-laminate material consisting of an inner thin layer of synthetic rubber sandwiched between layers of woven Nylon fabric to provide a dry suit. The inner layer could be made of polyurethane. Any suitable waterproof material heretofore used to fabricate diving suits may be utilized including GORTEX® fabric and TEFLON® coated fabric. Suitable waterproof zippers are commercially available from YKK, New Zipper Company, EOB, Dynet and Taylon. A lanyard 25 (FIG. 2) has an inner end tied to the tab of the zipper slide. The diver can grasp the lanyard 25 with his or her right hand and pull the zipper slide from the right shoulder to the mid-lower back to close and seal the opening 24 along its entire length.

The diving suit 10 includes means for holding the extended torso portion 23 in a folded- over condition to configure the suit body 12 to conform to a height of the diver as is well known in the art. The extended torso portion 23 is folded up and inside the lower part of the upper torso portion 14 as needed to adjust to the diver's height. A crotch strap 26 (FIG. 2) has one end secured to the lower portion of the back panel of the upper torso portion 14. The other end of the strap 26 has a male plastic coupling 28 of the type used on back packs that can be releasably snapped into a female coupling 30 (FIG. 1) secured to the lower portion of the front panel of the upper torso portion 14. Alternatively, the diving suit 10 can be provided with holding means in the form of a pair of releasable suspenders and mating couplers, as disclosed in the aforementioned U.S. Pat. No. 4,464,795 of Long et al., the entire disclosure of which is hereby incorporated by reference.

Figure 3:
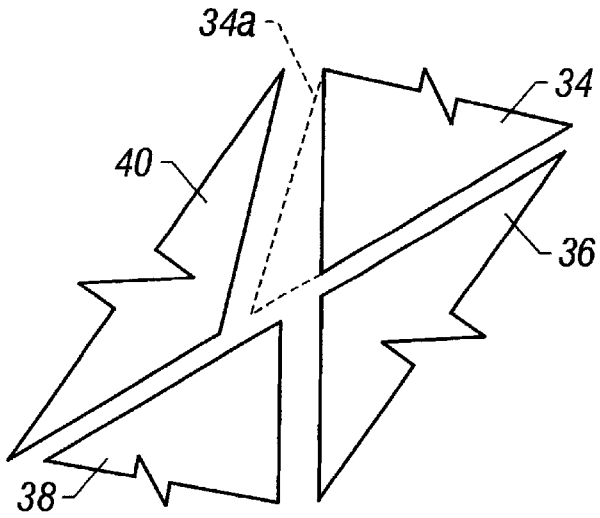
FIG. 3 is a diagrammatic view illustrating a technique for joining sections of the diving suit to accommodate the radius of curvature in the curved segment of the opening in the suit that connects the straight diagonal segment with the waist encircling segment.

FIG. 3 is a diagrammatic view illustrating a technique for joining sections of the suit body 12 to accommodate the radius of curvature in the curved segment 24*c* of the opening 24 in the suit body 12 that connects the upper straight diagonal segment 24*a* with the lower waist encircling segment 24*b*. A plurality of sections 34, 36, 38 and 40 of the upper torso portion of the suit body are configured, positioned and secured to decrease a radius of curvature of the curved segment 24*c* of the zippered opening 24. The section 34 has a triangular extension 34*a* illustrated in phantom lines that decreases the radius of curvature of the curved segment 24*c*.

Figure 4:
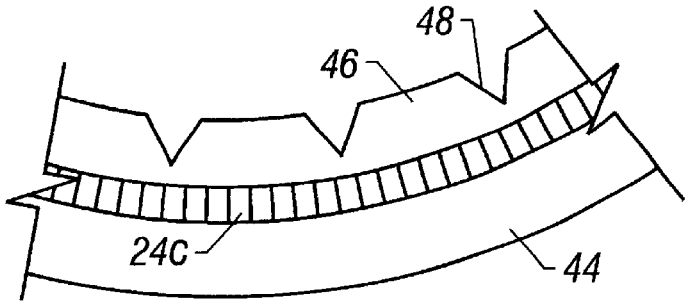
FIG. 4 is a diagrammatic view illustrating another technique for accommodating the radius of curvature in curved segment of the opening in the suit.

FIG. 4 is a diagrammatic view illustrating another technique for accommodating the radius of curvature in the curved segment 24*c* of the zippered opening. The zipper 42 has a pair of side flange strips or tapes 44 and 46. A plurality of triangular-shaped cuts 48 are made in the upper tape 46.

Figure 5:
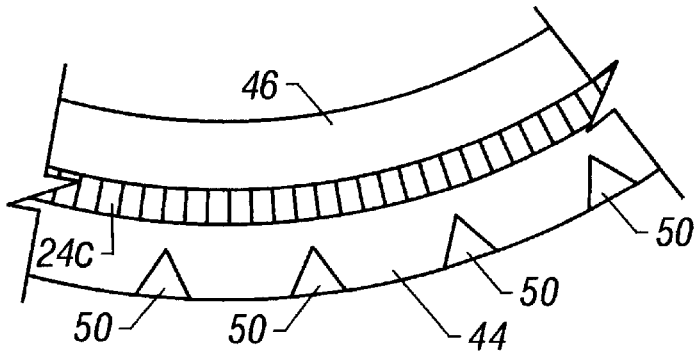
FIG. 5 is a diagrammatic view illustrating yet another technique for accommodating the radius of curvature in the curved segment of the opening in the suit.

FIG. 5 is a diagrammatic view illustrating yet another technique for accommodating the radius of curvature in the curved segment 24*c*. A plurality of triangular shaped additions 50 are made to the lower flange strip 44 of the zipper 42.

Figure 6:
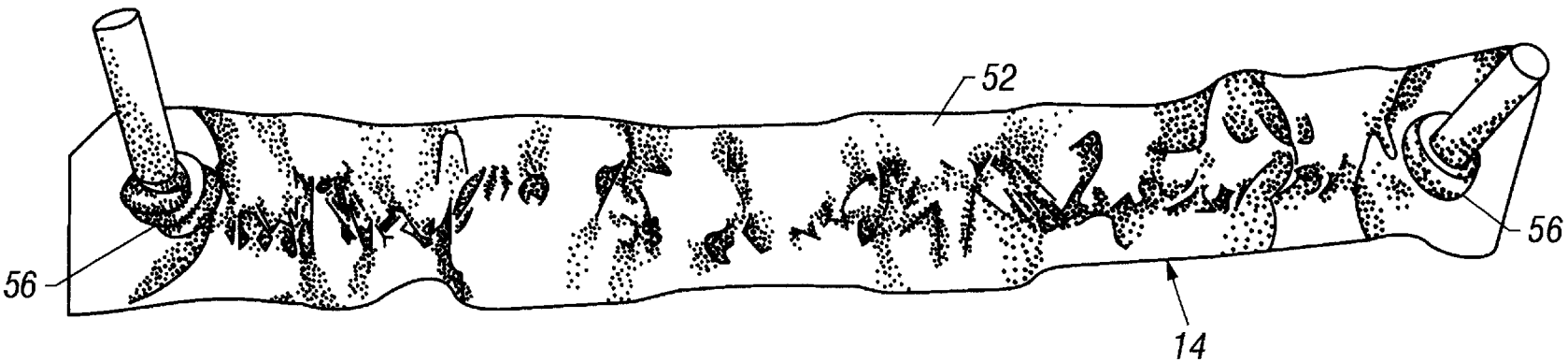
FIG. 6 is an enlarged fragmentary view of the inside of the back panel of the upper torso portion of the diving suit of FIGS. 1 and 2 illustrating its gathered portion.

FIG. 6 is an enlarged fragmentary view of the inside of the back panel of the upper torso portion 14 of the diving suit 10 of FIGS. 1 and 2 illustrating its gathered portion 52. An elastic cord extends between the layers of the laminate fabric material that makes up the back panel of the upper torso portion 14, through grommets (not visible) secured in the fabric material and is tied into knots 56 at each end. This arrangement helps keep the waist portion of the suit body 12 snug against the diver's waist.

Referring to FIG. 1 a conventional air inlet valve 60 is secured in the front panel of the upper torso portion 14. It is releasably connected to an air line to allow the interior of the suit body 12 to be partially inflated for comfort adjustment and buoyancy control. A conventional manually activated air release valve 62 allows air to be vented from the interior of the suit body 12 for comfort adjustment and buoyancy control.

While I have described a preferred embodiment of my diver's suit, it will be apparent to those skilled in the art that my invention my be modified in arrangement and detail. For example, the lower segment 24*b* of the zippered opening could be extended all the way across the back panel of the upper torso portion 14 to the left hip area, or even further around the waist area to a point adjacent to the lower end of the upper straight diagonal segment 24*a*. The suit body 12 need not include the extended torso portion 23 and it could include the stretchable waist band disclosed in the aforementioned U.S. Pat. No. 5,806,090 of Johnson, the entire disclosure of which is hereby incorporated. My invention is applicable to other one-piece garments besides diver's suits, such as anti-exposure suits, hazardous materials suits, and so forth. Therefore, the protection afforded my invention should only be limited in accordance with the scope of the following claims.

I claim:

1. A one-piece garment, comprising:

a suit body made of a waterproof material and having an upper torso portion configured for enclosing an upper torso of a person and including a pair of sleeves for enclosing the person's arms and an opening for the person's neck, and a trousers portion for enclosing the person's legs, the upper torso portion further having an opening sealed by a zipper with an upper segment extending diagonally across a front panel of the upper torso portion from one shoulder area of the upper torso portion that is integrally connected to a lower segment partially encircling a waist area of the upper torso portion and extending to a back panel of the upper torso portion of the suit body.

2. The garment of claim 1 and further comprising a neck seal surrounding the neck opening.

3. The garment of claim 1 wherein the suit body further includes a pair of wrist seals each surrounding a corresponding sleeve end.

4. The garment of claim 1 wherein the suit body further includes an extended torso portion connecting the upper torso portion and the trousers portion.

5. The garment of claim 4 and further comprising means for holding the extended torso portion in a folded-over condition to configure the suit body to conform to a height of the person.

6. The garment of claim 5 wherein the holding means includes a releasable crotch strap.

7. The garment of claim 5 wherein the holding means includes a pair of releasable suspenders.

8. The garment of claim 1 wherein the lower segment of the zippered opening extends to a medial area of the back panel of the upper torso portion of the suit body.

9. The garment of claim 1 wherein the lower segment of the zippered opening extends generally transverse to a longitudinal axis of the suit body.

10. The garment of claim 1 wherein a plurality of sections of the suit body are configured, positioned and secured to decrease a radius of curvature of a curved segment of the zippered opening connecting a straight diagonal segment with the lower waist encircling segment.

11. A diving suit, comprising:

a suit body made of a waterproof material and having an upper torso portion configured for enclosing an upper torso of a diver and an opening for the diver's neck, and a trousers portion for enclosing the diver's legs, the upper torso portion further having an opening sealed by a zipper with an upper segment extending diagonally across a front panel of the upper torso portion from one shoulder area of the upper torso portion and a lower segment partially encircling a waist area of the upper torso portion, and further wherein a plurality of sections of the suit body are configured, positioned and secured to decrease a radius of curvature of a curved segment of the zippered opening connecting a straight diagonal segment with the lower waist encircling segment.

12. The diving suit of claim 11 wherein the upper torso portion of the suit body includes a pair of sleeves for enclosing the diver's arms.

13. The diving suit of claim 11 wherein the suit body further includes a pair of wrist seals each surrounding a corresponding sleeve end.

14. The diving suit of claim 11 wherein the suit body further includes an extended torso portion connecting the upper torso portion and the trousers portion.

15. The diving suit of claim 14 and further comprising means for holding the extended torso portion in a folded-over condition to configure the suit body to conform to a height of the diver.

16. The diving suit of claim 15 wherein the holding means includes a releasable crotch strap.

17. The diving suit of claim 15 wherein the holding means includes a pair of releasable suspenders.

18. The diving suit of claim 11 wherein the lower segment of the zippered opening extends to a medial area of a back panel of the upper torso portion of the suit body.

19. The diving suit of claim 11 wherein the lower segment of the zippered opening extends generally transverse to a longitudinal axis of the suit body.

20. A diving suit, comprising:

a suit body made of a waterproof material and having an upper torso portion configured for enclosing an upper torso of a diver, the upper torso portion including a neck seal defining an opening for the diver's neck, a pair of sleeves for enclosing the diver's arms, a pair of wrist seals each surrounding a corresponding end of a sleeve, the suit body further including a trousers portion for enclosing the diver's legs, and an extended torso portion connecting the upper torso portion and the trousers portion, and means for holding the extended torso portion in a folded- over condition to configure the suit body to conform to a height of the diver, the upper torso portion further having an opening sealed by a zipper with an upper segment extending diagonally across a front panel of the upper torso portion from one shoulder area of the upper torso portion and a lower segment partially encircling a waist area of the upper torso portion and extending to a medial area of a back panel of the upper torso portion of the suit body, and the lower segment of the zippered opening extending generally transverse to a longitudinal axis of the suit body.

* * * * *